US006390456B1

(12) United States Patent
Lee et al.

(10) Patent No.: US 6,390,456 B1
(45) Date of Patent: May 21, 2002

(54) BUBBLE GENERATING DEVICE

(76) Inventors: Sen-Yung Lee, 9F, No. 84, Section 3, Chang-Rong Road; Sheng-Jye Hwang, No. 28, Alley 1, Lane 176, Dong-An Road; Shueei-Muh Lin, No. 17, Lane 99, Ming-Shin Road, all of Tainan City; Hsin-Mao Hsieh, No. 6, East Section, Industrial Sixth Road, Pin-Tong City, all of (TW)

( * ) Notice: Subject to any disclaimer, the term of this patent is extended or adjusted under 35 U.S.C. 154(b) by 0 days.

(21) Appl. No.: 09/725,917

(22) Filed: Nov. 30, 2000

(51) Int. Cl.[7] ..... B01F 3/04
(52) U.S. Cl. ..... 261/120; 261/122.1; 210/242.2
(58) Field of Search ..... 261/120, 122.1, 261/122.2; 210/242.2

(56) References Cited

U.S. PATENT DOCUMENTS 3,746,323 A * 7/1973 Buffington ..... 261/122.1
4,229,302 A * 10/1980 Molvar ..... 261/120
4,288,394 A * 9/1981 Ewing et al. ..... 261/122.1
4,448,689 A * 5/1984 Von Nordenskjold ..... 261/120
4,735,750 A * 4/1988 Damann ..... 261/120
4,797,063 A * 1/1989 Lot ..... 261/120
4,820,457 A * 4/1989 Jager ..... 261/120
5,690,864 A * 11/1997 Tyer ..... 261/122.1
5,858,283 A * 1/1999 Burris ..... 261/122.1

FOREIGN PATENT DOCUMENTS

FR 1207073 * 2/1960 ..... 261/120

* cited by examiner

*Primary Examiner*—C. Scott Bushey
(74) *Attorney, Agent, or Firm*—Rosenberg, Klein & Lee

(57) ABSTRACT

A bubble generating device includes a central tube having a hollow interior and a float is connected to the central tube. The central tube extends through a disk and a porous film is fixedly mounted to a peripheral wall of the disk A U-shaped tube is connected to the disk and communicates with the hollow interior of the central tube. Two ends of the U-shaped tube respectively communicate with a space between the disk and the porous film. Air enters from the central tube and flows out from two ends of the U-shaped tube to generate bubbles via the porous film.

6 Claims, 5 Drawing Sheets

BUBBLE GENERATING DEVICE

FIELD OF THE INVENTION

The present invention relates to a bubble generating device having a float and a weight to maintain the device in a desired position in the water and air enters into the device to generate bubbles in the water.

BACKGROUND OF THE INVENTION

A conventional bubble generating device is shown in FIG. 1 and generally includes a two blade means 101 driven by a motor 100. The bubble generating device is floated on water such as a pond, and the blade means 101 rotated to splash water in the air so that the water become many tiny water drops and fall into the water so as to increase the oxygen in the water. However, the bubble generating device cannot bear strong wind and the blades of the blade means 101 can only affect the water on the top surface of the water. FIG. 2 shows another bubble generating device which has two blades 102 on a shaft 103 and the device can be sunk in water. The blades 102 stir the water in the casing 104 of the device to generate bubbles. This is a bulk device and requires a motor to drive the shaft and a gear reduction device to adjust the speed of the shaft. This is costly and the device cannot operate in deep water.

SUMMARY OF THE INVENTION

In accordance with one aspect of the present invention, there is provided a bubble generating device and includes a central tube having a hollow interior and. a float is connected to the central tube. A pipe is connected to the central tube and communicates with the hollow interior of the central tube. The central tube extends through a disk and a peripheral wall extends from the disk. A porous film is fixedly mounted to the peripheral wall of the disk. A passage communicates between the hollow interior of the central tube and a space between the disk and the porous film so that when air comes into the passage, bubbles are generated via the porous film.

The primary object of the present invention is to provide a bubble generating device that can be operated in desired depth of water and the has a simple structure.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
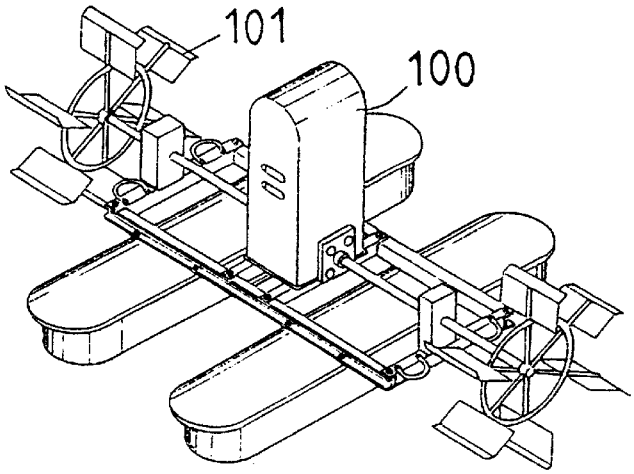
FIG.1 PRIOR ART
FIG. 1 shows a conventional bubble generating device.
Figure 2:
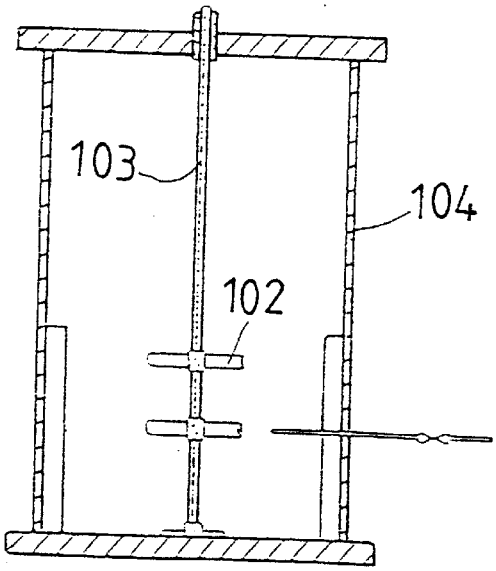
FIG.2 PRIOR ART
FIG. 2 is a cross sectional view to show another conventional bubble generating device.
Figure 3:
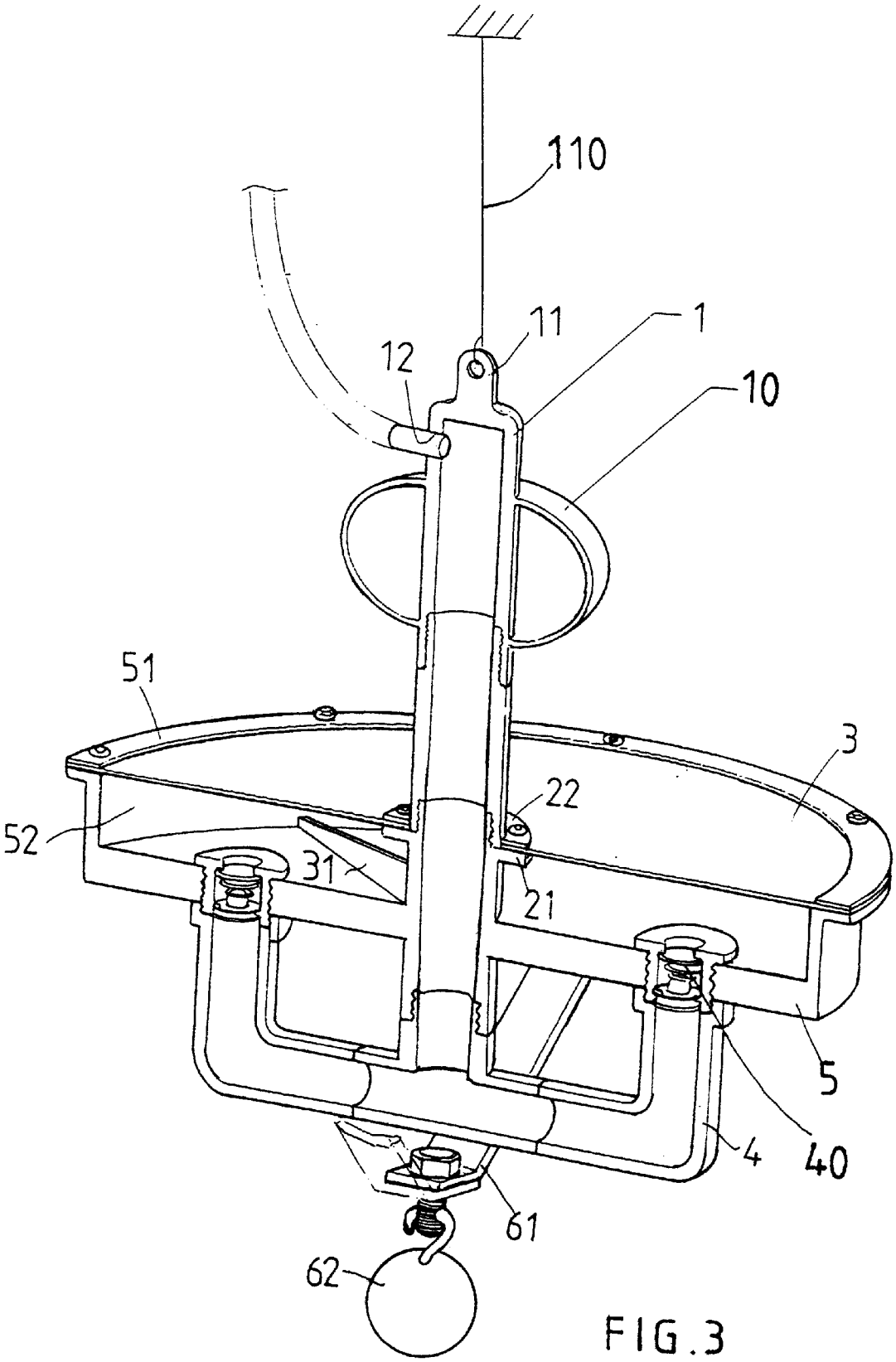
FIG. 3 is a perspective view, partly removed, to show the bubble generating device of the present invention.
Figure 4:
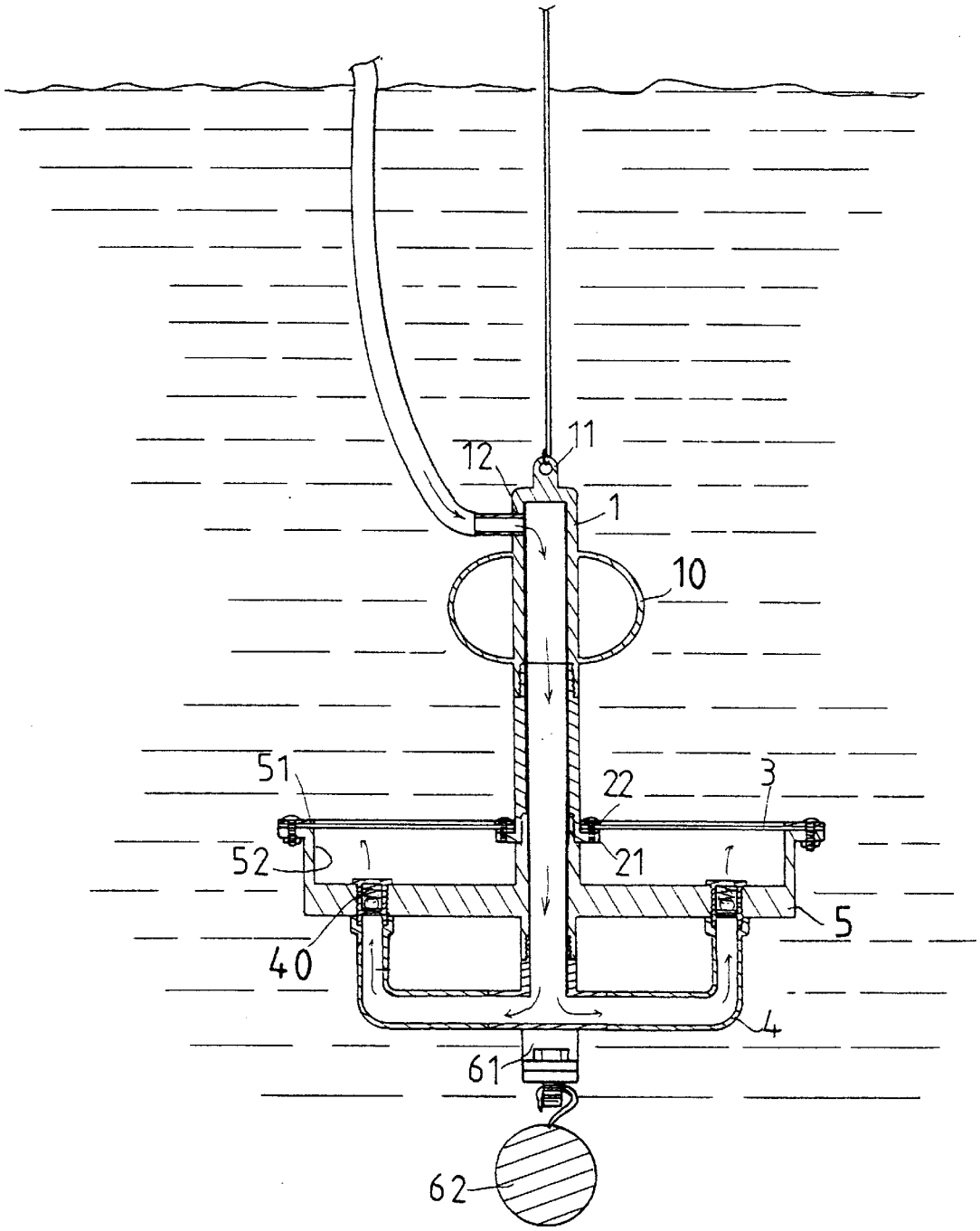
FIG. 4 is a cross sectional view to show the bubble generating device of the present invention is operated in water.

Referring to FIGS. 3 and 4, the bubble generating device of the present invention comprises a central tube 1 having a hollow interior and the central tube 1 is composed of several sections threadedly connected with each other. A hole 11 is defined in a top of the central tube 1 so that a cable 110 can be tied with the hole 11 and hang the device. A float 10 is connected to the central tube 1 so as to provide an upward force when the device is sunk in water. A pipe 12 is connected to the central tube 1 and communicates with the hollow interior of the central tube 1.

The central tube 1 extends through a disk 5 and a peripheral wall 52 extends from the disk 5. A porous film 3 is fixedly mounted to the peripheral wall 52 of the disk 5 by pressing a ring 51 thereon and a collar 22 is pressed on the film 3 and fixedly connected to a flange 21 extending from one of the sections of the central tube 1 by bolts. At least one enforcement rib 31 is provided on the disk 5 to let the disk have enough stiffness so that when the disk 5 is in the water, it will not be deformed.

A U-shaped tube 4 is connected to the disk 5 and communicates with the hollow interior of the central tube 1. Two ends of the U-shaped tube 4 respectively communicate with a space between the disk 5 and the porous film 3. Two uni-direction valves 40 are respectively received in the two ends of the U-shaped tube 4 to prevent the water from entering the U-shaped tube 4. Air enters into the hollow interior of the central tube 1 and the U-shaped tube 4 from the pipe 12, and when the air comes into the space between the disk 5 and the porous film 3, bubbles are generated via the porous film 3. A frame 61 extends from the disk 5 and a weight 62 connected to the frame 61.

The device can be lowered into water because the weight of the weight 62 and the float 10 provide an upward force so that the device can be stayed at a desired depth in the water. The float 10 ensures the film 3 is always facing upward. By this way, the device can be operated in water and will not be affected by. strong wind because only the cable 110 is exposed out of the water.

Figure 5:
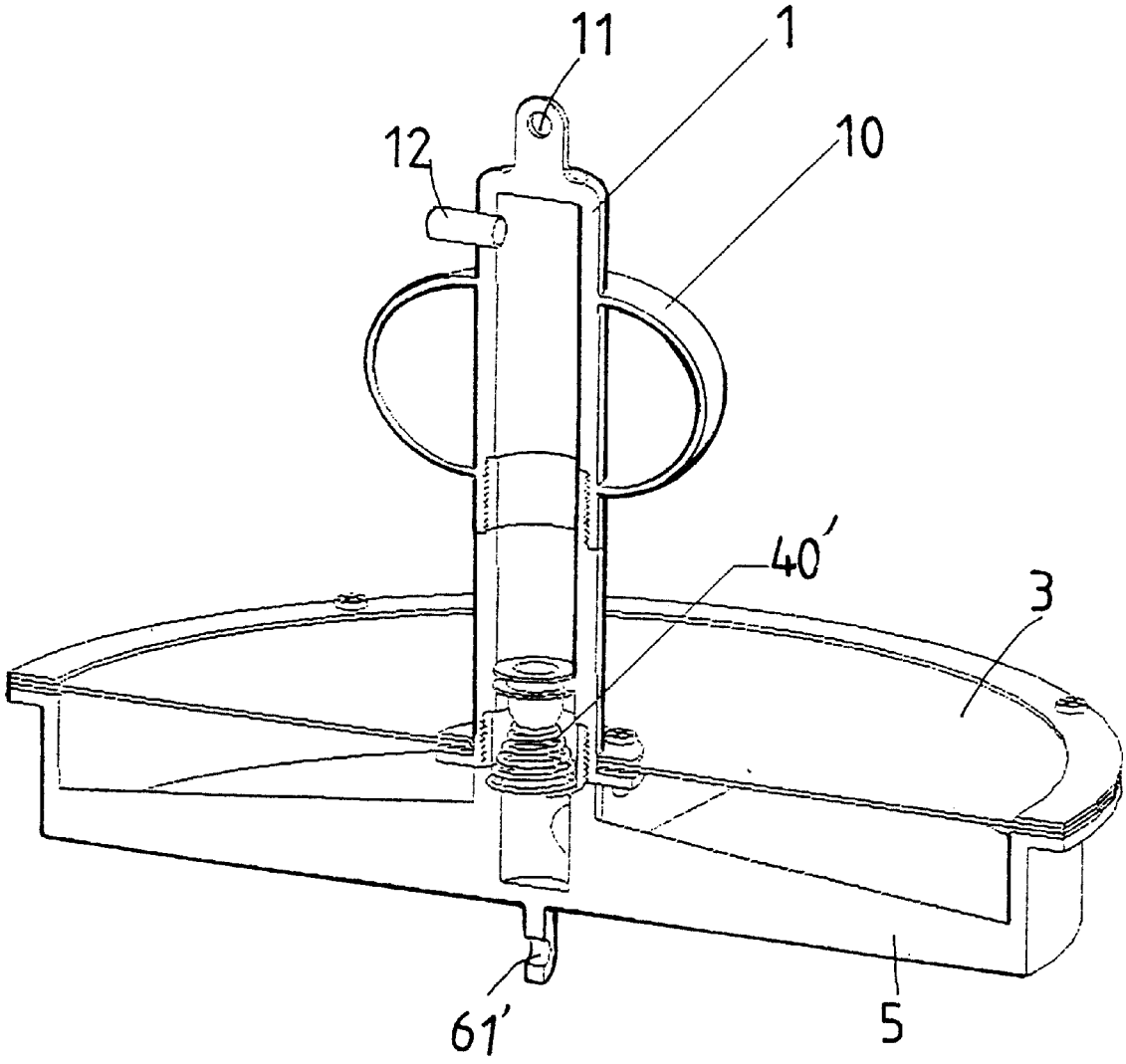
FIG. 5 is a perspective view, partly removed, to show another embodiment of the bubble generating device of the present invention.
Figure 6:
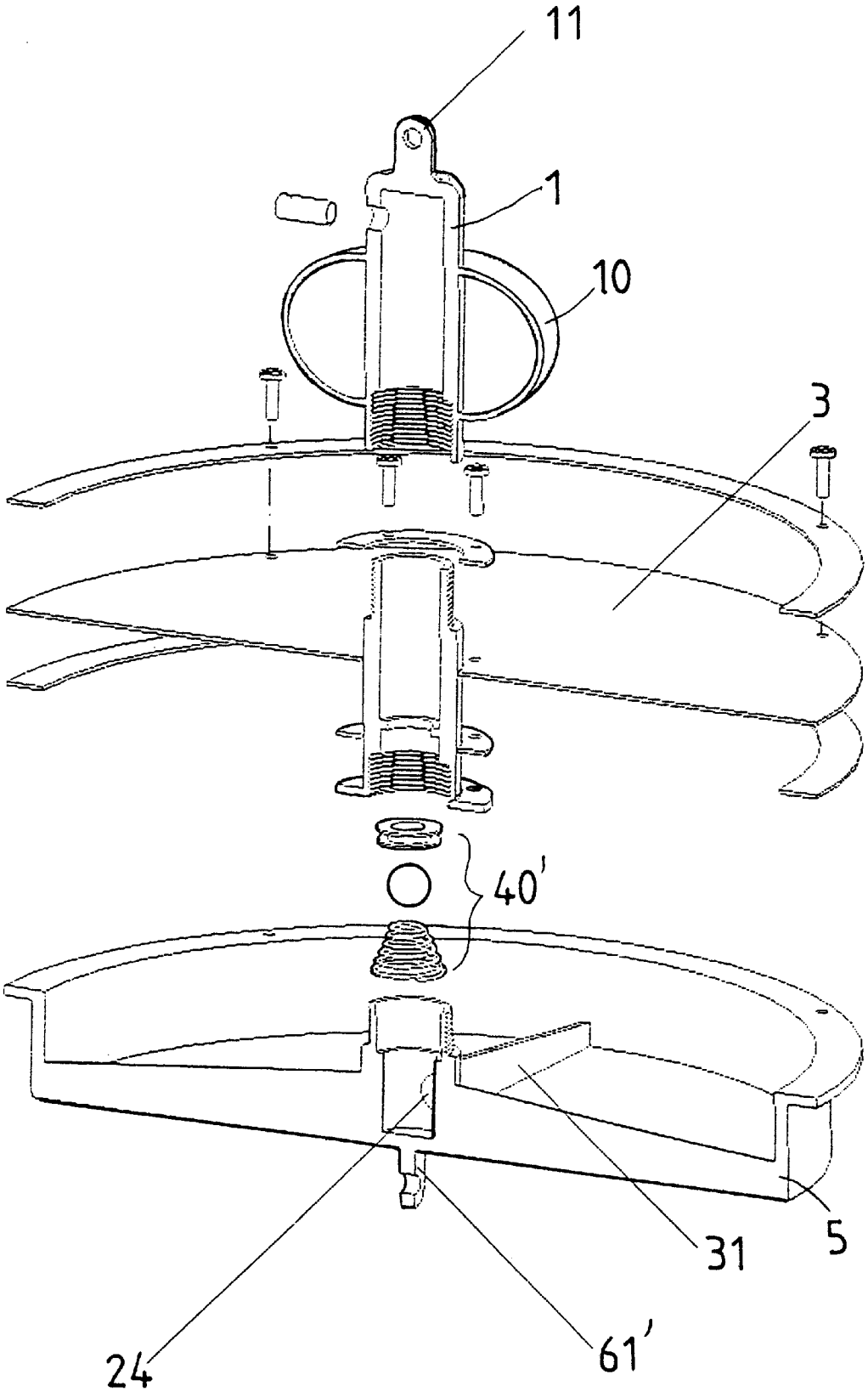
FIG. 6 is an exploded view to show of the bubble generating device of the present invention as shown in FIG. 5.

Referring to FIGS. 5 and 6, another embodiment of the device has no U-shaped tube and only a hole 24 defined through the central tube 1 and communicating with the space, between the disk 5 and the porous film 3. A uni-direction valve 40' is received in the central tube 1 to prevent water entering the central tube 1 from the hole 24. A hook 61' extends from an underside of the disk 5 to hook a weight (not shown).

While we have shown and described various embodiments in accordance with the present invention, it should be clear to those skilled in the art that further embodiments may be made without departing from the scope and spirit of the present invention.

What is claimed is:

1. A bubble generating device comprising:

a central tube having a hollow interior and a float connected to said central tube, a pipe connected to said central tube and communicating with said hollow interior of said central tube, said pipe adapted to be connected to a source of air;

said central tube extending through a disk and a peripheral wall extending from said disk, a porous film fixedly mounted to said peripheral wall of said disk and adapted to be submerged into water, and at least one passage communicating between said hollow interior of said central tube and a space between said disk and said porous film.

2. The device as claimed in claim 1 further comprising a hole defined in a top of said central tube so that a cable tied with said hole.

3. The device as claimed in claim 1 further comprising a frame extending from said disk and a weight connected to said frame.

4. The device as claimed in claim 1 wherein said at least one passage is defined by a U-shaped tube which is connected to said disk and communicates with said hollow interior of said central tube, two ends of said U-shaped tube respectively communicating with said space between said disk and said porous film.

5. The device as claimed in claim 4 further comprising two uni-direction valves respectively received in said two ends of said U-shaped tube.

6. The device as claimed in claim 1, wherein a uni-direction valve is received in said hollow interior of said central tube.

* * * * *